US006087658A

United States Patent [19]

Kawato

[11] Patent Number: 6,087,658

[45] Date of Patent: Jul. 11, 2000

[54] ION TRAP

[75] Inventor: Eizo Kawato, Kyoto, Japan

[73] Assignee: Shimadzu Corporation, Kyoto, Japan

[21] Appl. No.: 09/031,875

[22] Filed: Feb. 27, 1998

[30] Foreign Application Priority Data

Feb. 28, 1997 [JP] Japan ..... 9-045341

[51] Int. Cl.[7] ..... H01J 49/42

[52] U.S. Cl. ..... 250/292

[58] Field of Search ..... 250/292, 291, 250/290, 281

[56] References Cited

U.S. PATENT DOCUMENTS 5,055,678 10/1991 Taylor et al. ..... 250/291

5,420,425 5/1995 Bier et al. ..... 250/292

5,796,100 8/1998 Palermo ..... 250/292

*Primary Examiner*—Kiet T. Nguyen

*Attorney, Agent, or Firm*—Armstrong, Westerman, Hattori, McLeland & Naughton

[57] ABSTRACT

An ion trap is composed of a ring electrode and a pair of end cap electrodes, and each of the end cap electrodes is provided with a central hole (or holes) for introducing electrons for making ions or ions into, and for ejecting ions from, and with the analyzing space surrounded by the electrodes. In the inventive ion trap, a bulge is formed around the internal end of each of the central boles. The bulge corrects the deviation in the electric field from the pure quadrupole electric field and further controls the deviation around a central hole (or holes) effectively to provide a better performance for a mass spectrometer.

12 Claims, 7 Drawing Sheets

ION TRAP

The present invention relates to an ion trap comprising of a ring electrode and a pair of and cap electrodes manipulating ions for storage, selection, fragmentation and ejection, especially for an ion trap mass spectrometer.

BACKGROUND OF THE INVENTION

The inner surfaces of the ring electrode and the end cap electrodes of an ion trap mass spectrometer are shaped hyperboloids, having a hyperbolic lateral surface in their central cross section. When an appropriate voltage is applied to these electrodes, an electric field is generated in the space surrounded by these electrodes which provides the analyzing space of the mass spectrometer. The electric field, $\phi(r,z)$, is ideally represented by the following quadrupole electric field as:

$$\phi(r,z) \propto r^2-2z^2 \quad (1),$$

where r and z are the coordinates of the cylindrical coordinate system with r denoting the distance from the central axis of the ion trap toward the ring electrode, and z denoting the distance from the center of the ion trap toward an end cap electrode.

When an RF (radio frequency) voltage V of frequency $\Omega$ is applied to the ring electrode with a DC (direct current) voltage U superposed, ions are trapped in the analyzing space of the quadrupole electric field generated therein. The ion trapping condition is determined by various parameters including the RF voltage V, the frequency $\Omega$, the DC voltage U, and the dimensions of the apparatus (the radius $r_0$ of the ring electrode and the half distance $z_c$ between the end cap electrodes).

The ion trapping condition is represented, for example, by the $q_z$–$a_z$ plane as shown In stability diagram of FIG. 14. The equation of motion for an ion having mass m and electric charge e is given by the generalized Mathieu equation as:

$$d^2u/d\xi^2+(a_n-2\cdot q_n\cdot\cos(2\cdot\xi))\cdot u=0 \quad (2),$$

where $$u=x,\ y,\ z \quad (3),$$

$$\xi=\Omega\cdot t/2 \quad (4),$$

$$a_z=-2\cdot a_x=-2\cdot a_y=-8\cdot e\cdot U/(m\tau_0^2\cdot\Omega^2) \quad (5),$$

and $$q_z=-2\cdot q_x=-2\cdot q_y=4\cdot e\cdot V/(m\tau_0^2\cdot\Omega^2) \quad (6).$$

The parameters $a_z$ and $q_z$ are determined by the mass to charge ratio m/e of the ion. When a set of parameters ($a_z$, $q_z$) lies within the stability region as shown in FIG. 14, an ion of corresponding m/e oscillates at a certain frequency, which is called the secular frequency, and Is trapped in the analyzing space. The parameter $\beta$ in FIG. 14 is a value depending on the parameter q.

In an ion trap mass spectrometer, a mass spectrum is obtained through a method using the mass-selective instability scan mode in which ions are ejected through one or a plurality of holes formed at the center of an end cap electrode and are detected while the RF voltage V is continuously increased. When RF voltage is solely applied to the electrodes, $a_z$ is zero ($a_x$=0) and $q_z$ has a certain value depending on the m/e ratio of the ion. As the RF voltage is increases, $q_z$ increases correspondingly. When a set of parameters ($a_z$, $q_z$) approaches the boundary of the stability region ($a_z$=0, $q_z$=0.908), oscillation of ions along the z direction becomes unstable, and ions are ejected through the hole or holes of the end cap electrode. This means that the RF voltage where ions are ejected is proportional to the m/e ratio, and a mass spectrum is obtained scanning the RF voltage V as a parameter representative of the m/e ratio.

Another method of obtaining a mass spectrum in an ion trap mass spectrometer is the resonance ejection mode in which, similarly to the previous method, a mass spectrum is obtained while the RF voltage is continuously increased. An auxiliary AC (alternating current) voltage is applied between the end cap electrodes. When the frequency of the auxiliary AC voltage coincides with the secular frequency of ions, the AC voltage excites a resonance oscillation of the ions and ejects them from the analyzing space. Thus a mass spectrum is obtained through ejection of ions at the frequency of the auxiliary AC voltage because the secular frequencies of ions are determined by the parameters $a_z$ and $q_z$ and successively match the frequency with increasing RF voltage.

Since electrodes of an actual ion trap mass spectrometer must have finite dimensions, the theoretically infinite hyperbolic surface should be truncated at a finite extent. This causes a deviation of the actual electric field from a pure quadrupole electric field as used in the theory and deteriorates the performance of the mass spectrometer. The direction of the deviation in the peripheral region of the analyzing space tends to a lower electric field than a pure quadrupole electric field. When the electric field in the analyzing space is represented by multipole expansion, the signs of the quadrupole component and the sum of the other multipole components (hexapole and octopole, for example) are opposite.

This deviation reduces the force acting on the ions when the z-directional oscillation becomes unstable and the amplitude of the oscillation is increasing, at around $q_z$=0.908 in the mass-selective instability scan mode, compared to the case of using a pure quadrupole electric field. The reduction of the force is regarded as a reduction of the effective RF voltage, and of $q_z$, and the ion is pulled back into the stability region. This requires further increase of the RF voltage to eject the ions causing deterioration of performance, such as mass resolution. A similar problem is observed in the resonance ejection mode.

The deviation from a pure quadrupole field introduced by truncation of the electrodes can he alleviated by extending the position of the truncation but the deviation of the electric field still has an opposite sign to a pure quadrupole electric field. The aforementioned problem, the deterioration of the performance, can not be solved by this means.

Two methods are conventionally used to solve the problem. One is a method using a stretched geometry mode of the electrodes in which the end cap electrodes are separated further apart than the theoretically determined positions, as shown in FIG. 15. The other method is shown in FIG. 16 in which the surfaces of the ring electrode and the end cap electrodes are deviated from the theoretically required position so that the asymptotes are slightly skewed. The solid lines show theoretical positions of the asymptotes and dotted lines show their modifications in FIGS. 15 and 16. The two methods correct the deviations of the electric field by superposing electric fields of the same polarity as the quadrupole electric field throughout the analyzing space.

SUMMARY OF THE INVENTION

As described before, one or a plurality of small holes are formed at the center of the end cap electrodes to introduce ions into the analyzing space, or to introduce samples and electrons to generate ions inside the analyzing space or to eject ions from the analyzing space. The electric potential around the holes has a smaller curvature due to the field free space outside the analyzing space and a deviation of the field with opposite sign is introduced resulting in a deterioration of the performance of the mass spectrometer, such as resolution. While the deviation introduced by truncation at a finite electrode size is global in the analyzing space, the deviation caused by the holes in the end cap electrodes is local in the vicinity of the holes so that conventional methods as described above are rendered useless in correcting the pertinent deviation.

The present invention addresses the problem and provides an ion trap mass spectrometer in which the local deviation of the electric field caused by the holes in the end cap electrodes is properly controlled whereby the resolution is improved and the ion trapping performance is enhanced.

Thus, the present invention provides an ion trap having an end cap electrode with a hole or holes formed at its center wherein the local deviation of the electric field that occurs around the holes is controlled by forming a bulge either around each hole locally or all over the inner surface of the end cap electrode covering all the holes.

Thus, the present invention provides an ion trap comprising a ring electrode and a pair of end cap electrodes, each of said end cap electrodes having at least one hole at around the center thereof, and a surface of each of said end cap electrodes has a bulge formed around at least one of said hole or holes. The bulge is a local elevation or projection, for example, which is formed around the hole on the inner surface of the end cap electrode, whereby the local deviation of the electric field around the hole is controlled.

In the inventive ion trap, the electric field in the central part of the analyzing space is precisely corrected by a small amount to provide a pure quadratic field since the electric field in that part is affected mainly by the whole configuration of the electrodes. The correction of the electric field around the hole, on the other hand, is more effective than the conventional method since the surface of the electrode is closer into that part of the analyzing space because of the bulge. Thus, in the inventive ion trap, a desirable electric field is generated in the whole analyzing space without causing any undesirable change in the electric field in the central part of the analyzing space. The resolution of the mass spectrometer is improved since a high-order multipole electric field having the same polarity as that of the quadrupole electric field component is generated around the hole.

In still another modification of the inventive ion trap, each of said end cap electrodes has a plurality of holes at around the center thereof, and a bulge is formed around each of said holes on said surface of each of said end cap electrodes. The extent to which the electric field is controlled can be regulated by changing the height of the elevation or projection.

In a modification of the inventive ion trap, the bulge is a part of a cone whose lateral surface tangentially contacts the hyperbolic surface of the end cap electrode. The extent to which the electric field is to be controlled can be regulated by changing the radial position at which the cone contacts the surface of the end cap electrode.

In another modification of the inventive ion trap, the bulge is a part of a cone whose lateral surface contacts the hyperbolic surface of the end cap electrode at an angle. The extent to which the electric field is controlled can be regulated by changing the height of the cone.

In still another modification of the inventive ion trap, the bulge is a cylindrical projection. The extent to which the electric field is controlled can be regulated by changing the height of the cylindrical projection.

The present invention further provides an ion trap comprising a ring electrode and a pair of end cap electrodes having a plurality of holes at around the center thereof, wherein a surface of each of said end cap electrodes has a bulge covering all of said plurality of central holes. The extent to which the electric field is controlled can be regulated by changing the height of the elevation or projection.

Further, in the inventive ion trap, the bulge may be a projection which has a shape of lateral surface represented by a curve approaching a hyperbolic surface of an end cap electrode rapidly with getting farther from the central hole.

By the inventive ion trap, not only the local deviation of the electric field around the hole is corrected, but also the performances of the mass spectrometer (e.g. the resolution, the ion trapping performance, etc.) are improved owing to a superposition of high-order multipole electric field components having the same polarity as the quadrupole electric field component.

It should be obviously understood that any one of the central holes can be associated with a bulge,

BRIEF DESCRIPTION OF THE DRAWINGS

A preferred embodiment of the present invention will be detailed later, referring to the attached drawings, wherein.

DETAILED DESCRIPTION OF A PREFERRED EMBODIMENT

Figure 1:
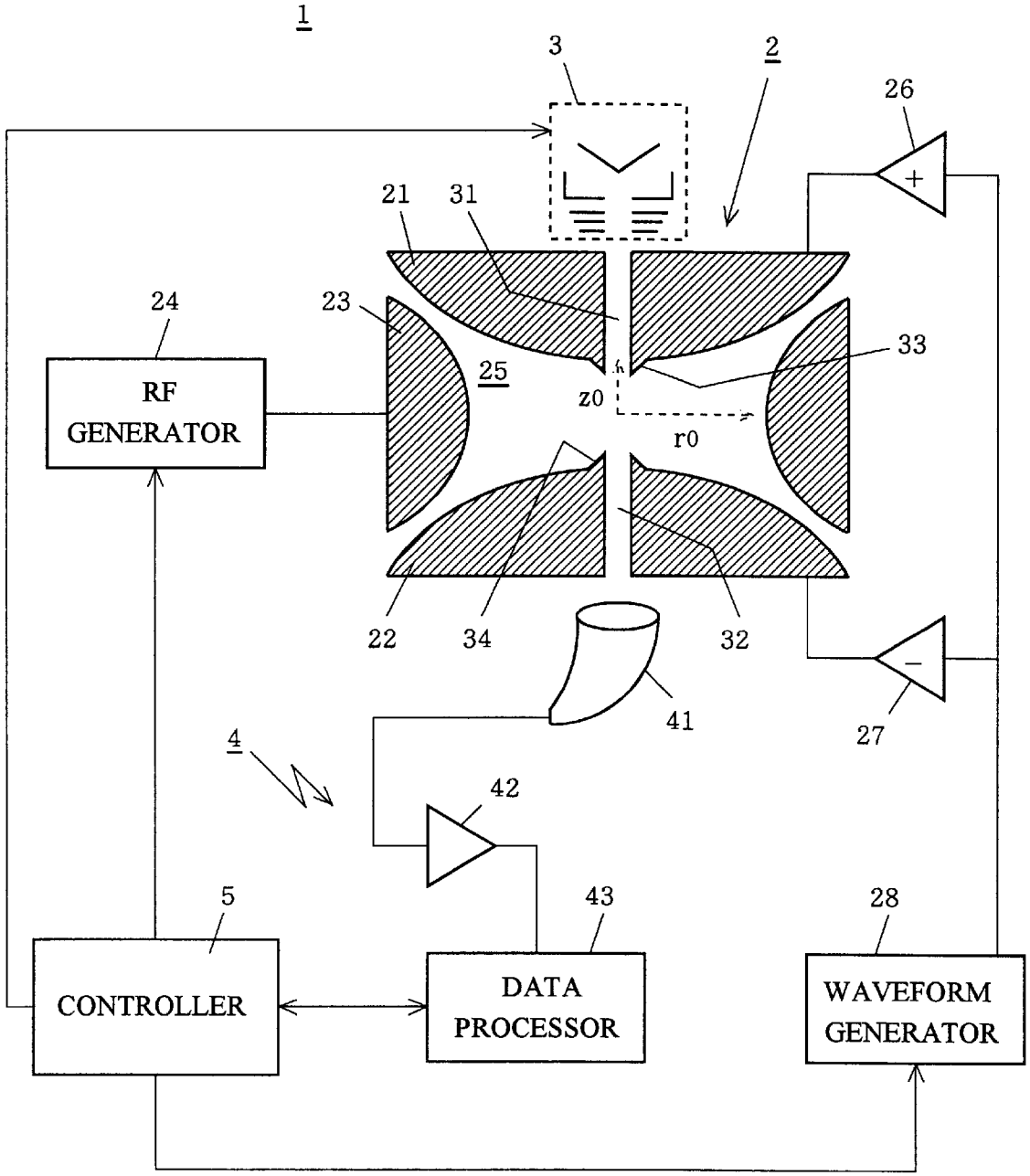
FIG. 1 shows a schematic configuration of a mass spectrometer including an ion trap embodying the present invention.

An ion trap mass spectrometer according to the present invention is shown in FIG. 1 where the ion trap mass spectrometer 1 includes an ion trap 2, an electron generator 3, an ion detector 4 and a controller 5. The ion trap 2 is used for generation, storage, selection, fragmentation and ejection of ions, and is composed of a ring electrode 23 and a pair of end cap electrodes 21 and 22. The ring electrode 23 is connected to an RF generator 24, which normally applies an RF voltage V-cos(Ω·t) of about 1MHz frequency to the ring electrode 23, while the voltage of the two end cap electrodes 21 and 22 is kept at zero.

The three electrodes 21, 22 and 23 define the analyzing space 25 whore the RF voltage generates the quadrupole electric field, and the quadrupole electric field traps ions within the analyzing space.

When voltages of opposite polarities are applied to the two end cap electrodes 21 and 22, a dipole electric field for excitation and/or ejection of ions is generated in the analyzing space 25. Amplifiers 26 and 27 are connected to the end cap electrodes 21 and 22 for absorbing RF electric current of the same phase through their low output impedance. The amplifiers 26 and 27 also apply voltages of opposite polarity generated by a waveforn generator 28.

The electron generator 3 is placed just outside of an end cap electrode 21 for injection of electrons into the analyzing space 25 through a hole (or holes) 31 in the end cap electrode 21 to generate ions. It is possible to provide an ion generator, instead of the electron generator 3, at the same place, whereby ions are externally introduced into the analyzing space 25.

An ion detector 41 is placed just outside of the other end cap electrode 22 to detect ions coming out through a hole (or holes) 32 in the end cap electrode 22. A pre-amplifier 42 and a data processor 43 are connected to the ion detector 41. The electron generator 3, RF generator 24, waveform generator 28 and the data processor 43 are all connected and controlled by the controller 5.

If the sizes of the hyperbolic surfaces of the ring electrode 23 and the end cap electrodes 21 and 22 are large enough compared to the characteristic dimension parameters of the ion trap 2 (i.e., $r_0$ and $z_0$), and if the end cap electrodes 21 and 22 have no hole 31 on 32, an ideal quadrupole electric field is formed in the analyzing space 25 of the ion trap 2. But the actual electric field has a deviation from the ideal field toward a smaller value around the holes 31 and 32, which deteriorates the performance of the mass spectrometer.

In the ion trap mass spectrometer of the present embodiment, bulges 33 and 34 are made around the holes 31 and 32 of the end cap electrodes 21 and 22, so that the local deviation of electric field around the boles 31 and 32 are corrected and controlled to provide a multipole electric field component making the performance, e.g. the mass resolution and the stability of trapping ions in the ion trap, improved.

Figure 2:
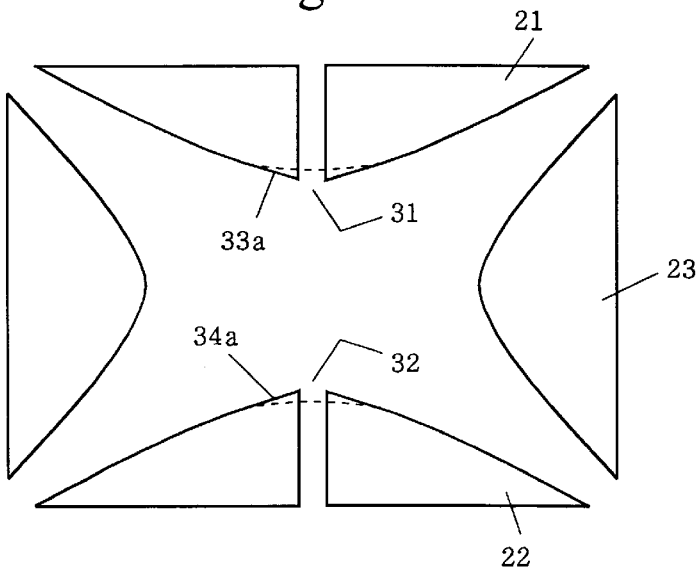
FIG. 2 shows the central cross section of a first example of the inventive ion trap.
Figure 3:
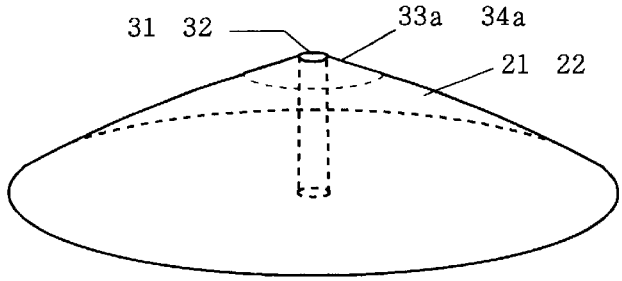
FIG. 3 shows a perspective view of an end cap electrode used in the above ion trap.

The embodiment is detailed referring to FIGS. 2–13. As shown in FIGS. 2 and 3, bulges 33*a* and 34*a* are formed around each of the holes 31 and 32 of the end cap electrodes 21 and 22 having a shape of circular cone whose lateral surface tangentially touches the hyperbolic surface of the end cap electrode at the circle larger than the end circle of the holes. Such a cone should form a bulge at the vertex of the hyperboloid of the end cap electrodes. The bulges shown in FIGS. 2 and 3 are exaggerated for the convenience of explanation, but actual bulges can be smaller for controlling the deviation of the electric field around the holes.

Figure 4:
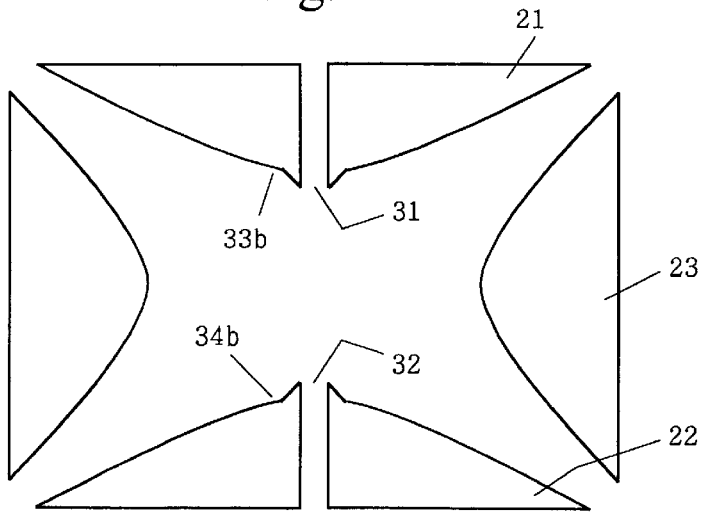
FIG. 4 shows the central cross section of a second example of the inventive ion trap.
Figure 5:
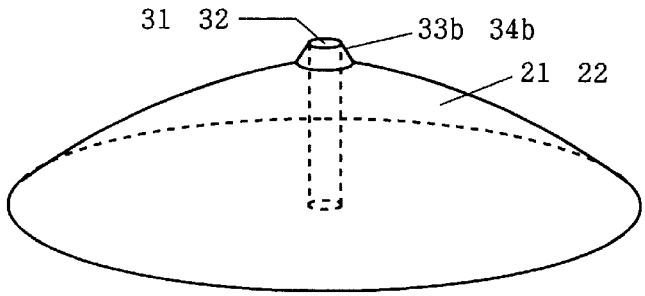
FIG. 5 shows a perspective view of an end cap electrode used in the above ion trap.

The second example of the bulge is shown in FIGS. 4 and 5, in which bulges 33*b* and 34*b* are shaped as a circular cone whose lateral surface is not necessarily tangent to the hyperbolic surface of the end cap electrodes 21 and 22. The bulges 33*b* and 34*b* shown in FIGS. 4 and 5 are also exaggerated for the convenience of explanation, but actual bulges can be smaller for controlling the deviation of the electric field around the holes.

The bulges 33*b* and 34*b* of the second example can control the electric field in a more limited area around the hole. The more the vertex angle is increased toward the tangential contact as in the first example, the larger the relative effect of the bulge to the electric field at the center of the ion trap compared with that around the hole. Thus, by adjusting the vertex angle of the circular cone in the second example, the correction in the electric field at the center of the analyzing space and further the adjustment of multipole component of the electric field around the hole can be simultaneously optimized.

Figure 6:
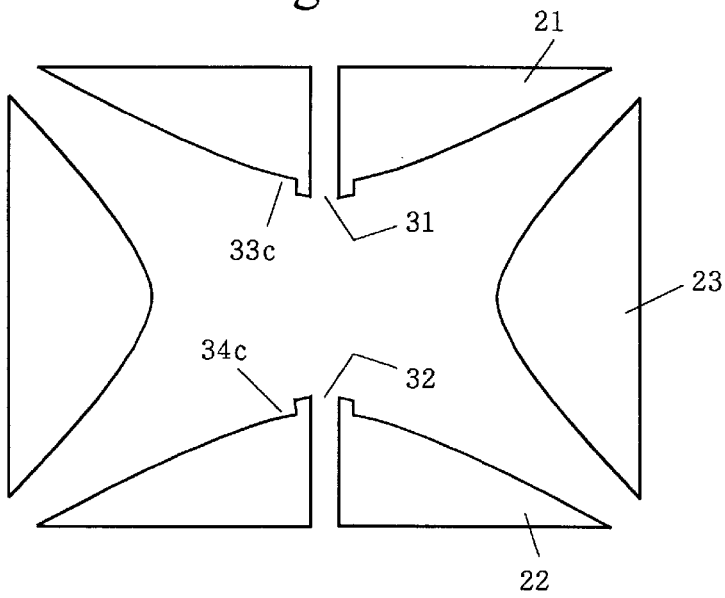
FIG. 6 shows the central cross section of a third example of the inventive ion trap.
Figure 7:
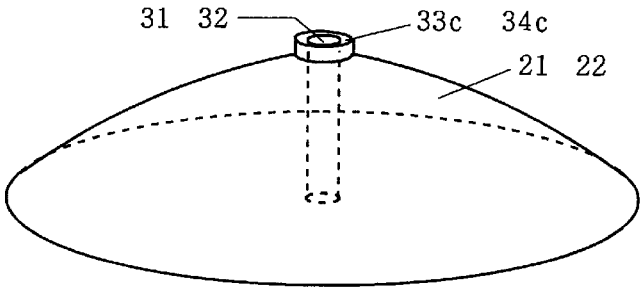
FIG. 7 shows a perspective view of an end cap electrode used in the above ion trap.

Third example of the bulge is shown in FIGS. 6 and 7. The bulge is such that the lateral surface of the bulge is generated by a functional curve. The curve can be selected so that the bulge may be limited to an area surrounding the hole as the previous examples, or may be global throughout the end cap electrode, in the latter case the curve of lateral surface of the bulge rapidly approaches to the theoretical hyperbolic surface of the inn trap as it goes apart from the hole.

The bulges 33*c* and 34*c* shown in FIGS. 6 and 7 are such that a partial area around the hole is raised by a certain amount, i.e. the bulge is like a cylinder. The lateral surface of the cylinder may be flared and/or the top surface of the cylinder may be flat (true cylinder). The bulges 33*c* and 34*c* shown in FIGS. 6 and 7 are also exaggerated for the convenience of explanation, but actual bulges can be smaller for controlling the deviation of the electric field around the hole.

Figure 8:
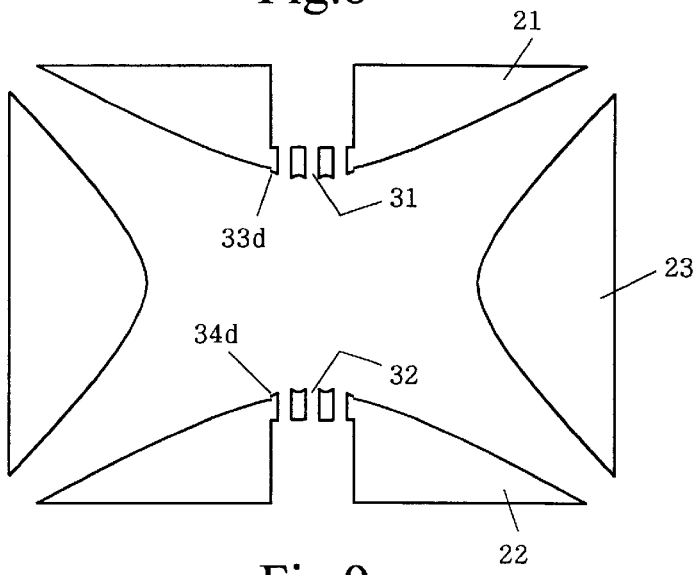
FIG. 8 shows the central cross section of a fourth example of the inventive ion trap.
Figure 9:
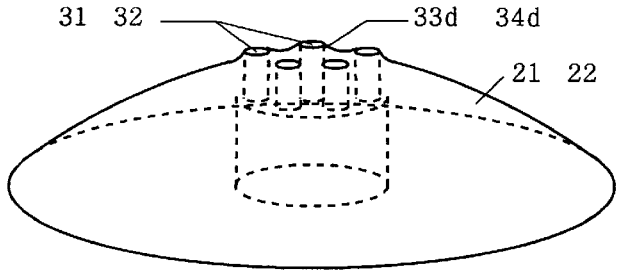
FIG. 9 shows a perspective view of an end cap electrode used in the above ion trap.
Figure 10:
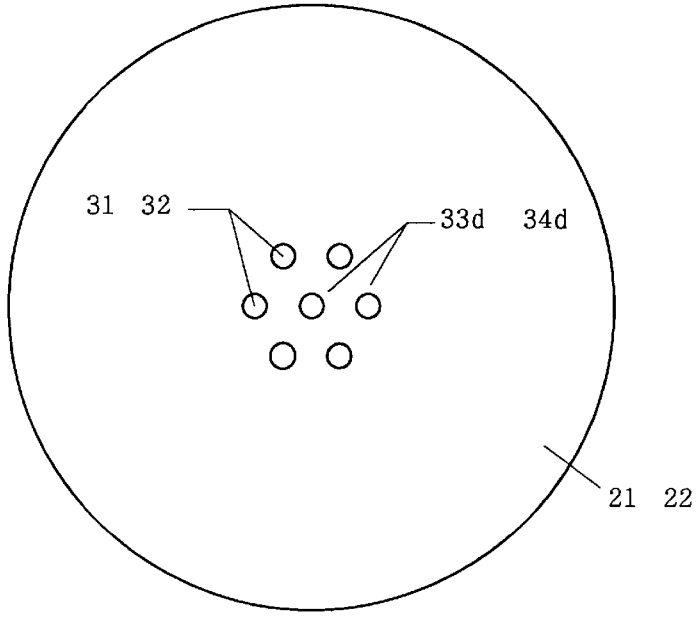
FIG. 10 shows a plan view of the above end cap electrode.

The fourth example of the bulge is shown in FIGS. 8–10 where the present invention is applied to an end cap electrode having a plurality of holes. In this case, bulges 33*d* and 34*d* are formed at around each of the plurality of holes 31 and 32 of the end cap electrodes 21 and 22. The bulges 33*d* and 34*d* shown in FIGS. 8–10 are also exaggerated for the convenience of explanation, but actual bulges can be smaller for controlling the deviation of the electric field at around the hole.

Figure 11:
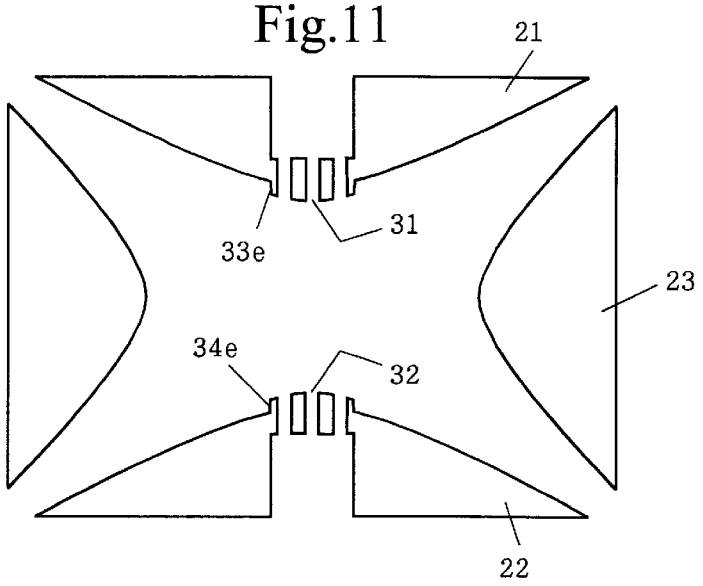
FIG. 11 shows the central cross section of a fifth example of the inventive ion trap.
Figure 12:
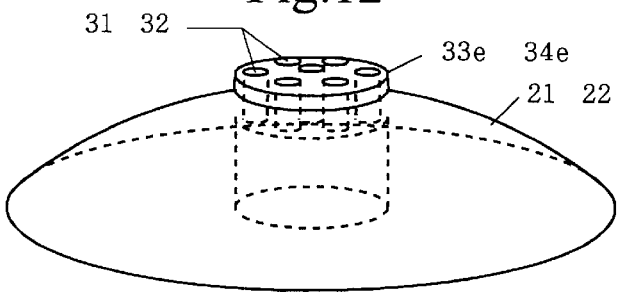
FIG. 12 shows a perspective view of an end cap electrode used in the above ion trap.
Figure 13:
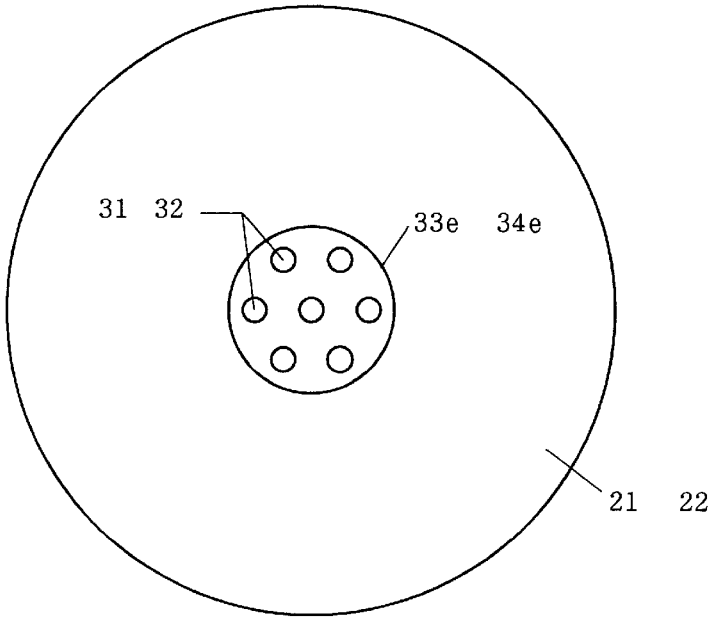
FIG. 13 shows a plan view of the above end cap electrode.
Figure 14:
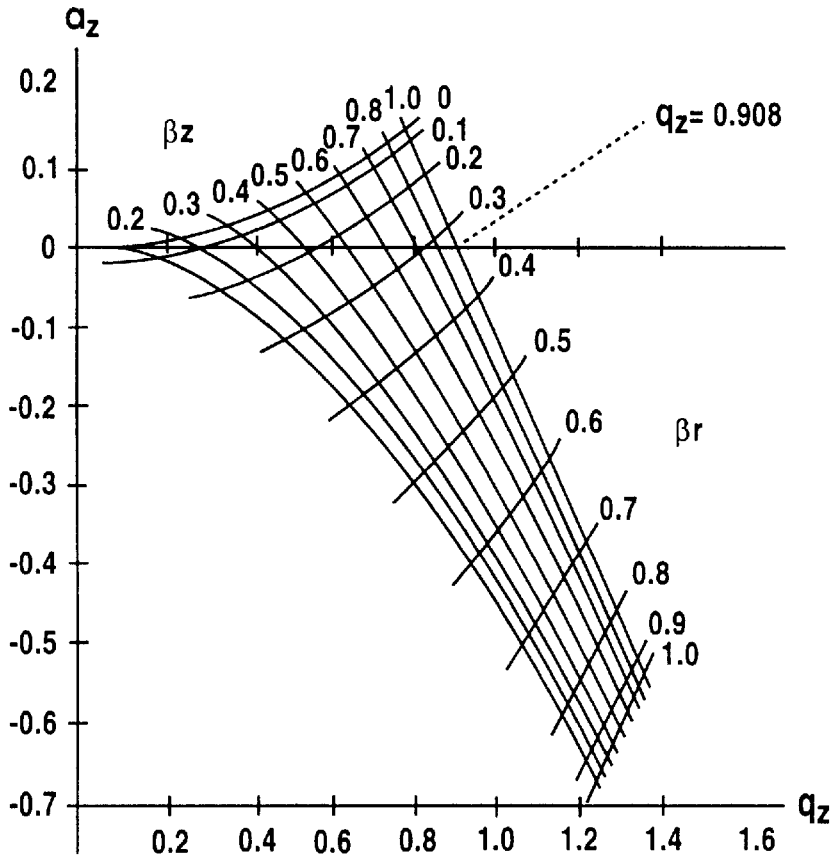
FIG. 14 shows a stability diagram for the ion trap shown in the $q_z$—$a_z$ plane.
Figure 15:
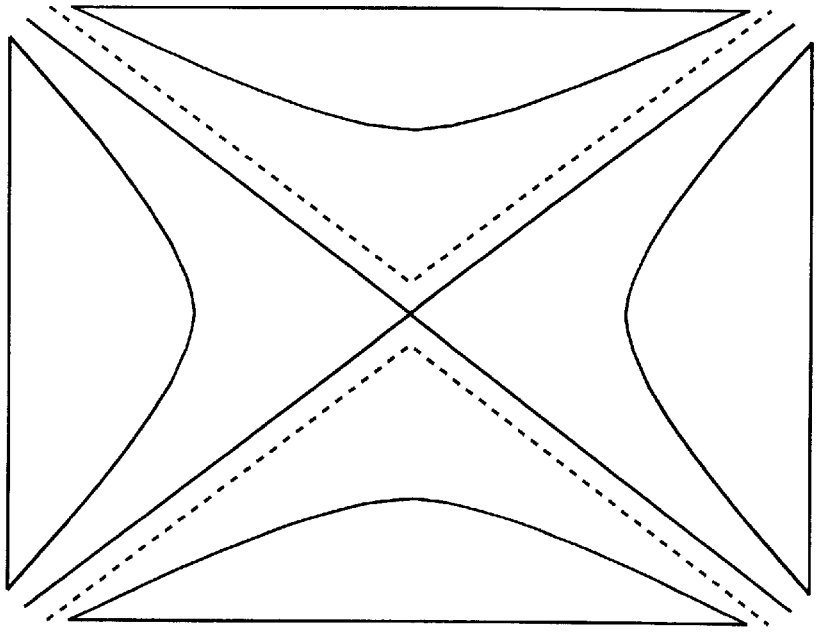
Fig.15 PRIOR ART
FIG. 15 is a diagram for explaining a conventional method of correcting a deviation in a electric field.
Figure 16:
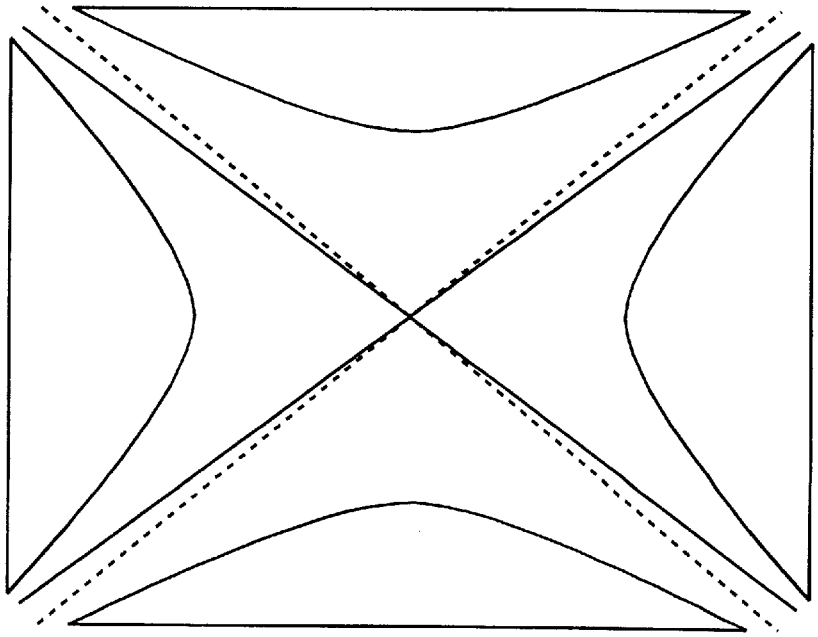
Fig.16 PRIOR ART
FIG. 16 Is a diagram for explaining another conventional method of correcting a deviation in a electric field.

The fifth example of the bulge is shown in FIGS. 11–13 where the present invention is applied to an end cap electrode having a plurality of holes. In this case, bulges 33*e* and 34*e* are formed at the area covering the plurality of holes 31 and 32. The bulges 33*e* and 34*c* are shaped cylindrically or according to a certain functional curve as described in the third example. The bulges 33*e* and 34*c* shown in FIGS. 11–13 are also exaggerated for the convenience of explanation, but actual bulges can be smaller for controlling the deviation of the electric field around the hole.

The external surfaces of the end cap electrodes 21 and 22 are shown flat in FIGS. 1–13. It is possible to form the external surfaces with a shape similar to the internal (hyperbolic) surface, tapered surface or hollowed surface in any kind, so that the end cap electrodes can have a thin wall in order to incorporate variety of means such as a lens system to focus ions extracted from the ion trap or being injected into the ion trap.

What is claimed is:

1. An ion trap comprising a ring electrode and a pair of end cap electrodes, each of said end cap electrodes having at least one hole at around the center thereof, and a surface of each of said end cap electrodes has a bulge formed around at least one of said hole or holes.

2. The ion trap according to claim 1, wherein each of said end cap electrodes has a plurality of holes at around the center thereof, and a bulge is formed around each of said holes on said surface of each of said end cap electrodes.

3. The ion trap according to claim 2 wherein said bulge is a part of a cone whose lateral surface contacts a hyperbolic surface of said end cap electrode tangentially.

4. The ion trap according to claim 2, wherein said bulge is a part of a cone whose lateral surface contacts a hyperbolic surface of said end cap electrode at an angle.

5. The ion trap according to claim 2, wherein said bulge is a cylindrical projection.

6. The ion trap according to claim 2, wherein said bulge is a projection which has a shape of a lateral surface represented by a curve approaching a hyperbolic surface of said end cap electrode rapidly with getting farther from said hole or holes.

7. The ion trap according to claim 1, wherein said bulge is a part of a cone whose lateral surface contacts a hyperbolic surface of said end cap electrode tangentially.

8. The ion trap according to claim 1, wherein said bulge is a pail of a cone whose lateral surface contacts a hyperbolic surface of said end cap electrode at an angle.

9. The ion trap according to claim 1, wherein said bulge is a cylindrical projection.

10. The ion trap according to claim 9, wherein said bulge is a projection which has a shape of a lateral surface represented by a curve approaching a hyperbolic surface of said end cap electrode rapidly with getting farther from said plurality of central holes.

11. The ion trap according to claim 1, wherein said bulge is a projection which has a shape of a lateral surface represented by a curve approaching a hyperbolic surface of said end cap electrode rapidly with getting farther from said hole or holes.

12. An ion trap comprising a ring electrode and a pair of end cap electrodes having a plurality of holes at around the center thereof, wherein a surface of each of said end cap electrodes has a bulge covering all of said plurality of central holes.

* * * * *